US006799117B1

(12) United States Patent
Proett et al.

(10) Patent No.: US 6,799,117 B1
(45) Date of Patent: Sep. 28, 2004

(54) PREDICTING SAMPLE QUALITY REAL TIME

(75) Inventors: Mark A. Proett, Missouri City, TX (US); Jianghui Wu, Austin, TX (US); James M. Fogal, Houston, TX (US); Madan Mohan Manohar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/446,366

(22) Filed: May 28, 2003

(51) Int. Cl.[7] ..... G01V 9/00
(52) U.S. Cl. ..... 702/12
(58) Field of Search ..... 702/6, 12, 13, 702/11; 703/10

(56) References Cited

U.S. PATENT DOCUMENTS

| | | | | |
|---|---|---|---|---|
| 5,251,286 A | | 10/1993 | Wiener et al. | 395/22 |
| 5,266,800 A | | 11/1993 | Mullins | 250/256 |
| 5,444,619 A | | 8/1995 | Hoskins et al. | 364/421 |
| 5,828,981 A | * | 10/1998 | Callender et al. | 702/6 |
| 6,274,865 B1 | | 8/2001 | Schroer et al. | 250/269.1 |
| 6,350,986 B1 | | 2/2002 | Mullins et al. | 250/269.1 |
| 6,424,919 B1 | | 7/2002 | Moran et al. | 702/6 |
| 6,490,527 B1 | * | 12/2002 | Utt | 702/9 |

OTHER PUBLICATIONS

Proett, Mark A., et al.: "Multiple Factors that Influence Wireline Formation Tester Pressure Measurements and Fluid Contact Estimates", (SPE 71566), 2001 SPE Annual Technical Conference and Exhibition, New Orleans, Louisiana, Sep. 30–Oct. 3, 2001.

Proett, Mark A., et al.: "Sample Quality Prediction with Integrated Oil and Water–Based Mud Invasion Modeling," (SPE 77964), SPE Asia Pacific Oil and Gas Conference and Exhibition, Melbourne, Australia, Oct. 8–10, 2002.

Akram, A.H., et al.: "A Model to Predict Wireline Formation Tester Sample Contamination," (SPE 59559), Revised for Publication from SPE 48959; SPE Reservoir Eval. & Eng. 2 (6), Dec. 1999.

Wu, J., et al.: "Inversion of Multi–Phase Petrophysical Properties Using Pumpout Sampling Data Acquired with a Wireline Formation Tester", (SPE 77345), SPE Annual Technical Conference and Exhibition, San Antonio, Texas, Sep. 29, 2002–Oct. 2, 2002.

Fadnes, Finn Hallstein, et al.: "Optimization of Wireline Sample Quality by Real–Time Analysis of Oil–Based Mud Contamination—Examples from North Sea Operations", (SPE 71736), 2001 SPE Annual Technical Conference and Exhibition, New Orleans, Louisiana, Sep. 30–Oct. 3, 2001.

Bouton, J., et al.: "Assessment of Sample Contamination by Downhole NMR Fluid Analysis", (SPE 71714), 2001 SPE Annual Technical Conference and Exhibition, New Orleans, Louisiana, Sep. 30–Oct. 3, 2001.

(List continued on next page.)

*Primary Examiner*—Donald McElheny, Jr.
(74) *Attorney, Agent, or Firm*—Baker Botts L.L.P.

(57) ABSTRACT

Systems and methods for estimating properties of fluid samples pumped from a formation through a well are described. Based upon input properties, an artificial neural network (ANN) may predict a plurality of data points, and each data point may correspond to a predicted time sample of the property of the fluid sample. Properties predicted by the ANN include sample quality or pumping pressure differential.

43 Claims, 7 Drawing Sheets

OTHER PUBLICATIONS

Mullins, Oliver C., et al.: "Real–Time Determination of Filtrate Contamination During Openhole Wireline Sampling by Optical Spectoscopy", (SPE 63071) 2000 SPE Annual Technical Conference and Exhibition, Dallas, Texas, Oct. 1–4, 2000.

Van Dusen, Alexandra, et al.: "Determination of Hydrocarbon Properties by Optical Analysis During Wireline Fluid Sampling", (SPE 63252), 2000 SPE Annual Technical Conference and Exhibition, Dallas, Texas, Oct. 1–4, 2000.

Freedman, R., et al.: "A New NMR Method of Fluid Characterization in Reservoir Rocks: Experimental Confirmation and Simulation Results", (SPE 63214), 2000 SPE Annual Technical Conference and Exhibition, Dallas, Texas, Oct. 1–4, 2000.

Morris, C.W., et al.: "Using Optical Fluid Analysis to Evaluate Downhole Fluid Sample Contamination", (SPE 50603), 1998 SPE European Petroleum Conference, The Hague, The Netherlands, Oct. 20–22, 1998.

Akram, A.H., et al.: "A Model to Predict Wireline Formation Tester Sample Contamination", (SPE 48959), 1998 SPE Annual Technical Conference and Exhibition, New Orleans, Louisiana, Sep. 27–30, 1998.

Hashem, M.N., et al.: "Determination of Producible Hydrocarbon Type and Oil Quality in Wells Drilled with Synthetic Oil–Based Muds," (SPE 55959), SPE Reservoir Eval. & Eng., 2 (2), Apr. 1999.

* cited by examiner

PREDICTING SAMPLE QUALITY REAL TIME

BACKGROUND OF THE INVENTION

1. Field of the Invention

This invention relates in general to predicting the output of a multiparameter system; and, more particularly, to a system and method for predicting properties of a formation fluid.

2. Description of the Prior Art

In drilling wells for the production of hydrocarbons from underground formations, drilling mud is typically cycled through a wellbore as it is being drilled. In addition to driving a drill motor and cleaning a drilling bit, the drilling mud also provides a column of fluid that exerts pressure on the formation pierced by the wellbore, which prevents or reduces fluid from a reservoir or formation from entering the wellbore. In addition, drilling mud may infiltrate the formation in the region surrounding the wellbore (the near wellbore region).

It is often useful in drilling oil wells to test the hydrocarbons present in formations along a wellbore. This is frequently accomplished through the use of a formation tester, which draws fluid from the formation and stores it for later testing or performs tests in the wellbore.

An example formation tester is a pumpout wireline formation tester (PWFT). A PWFT collects formation samples by extending a probe from a wireline tool until the probe presses against the side of the wellbore. Fluids are then pumped out of the formation and into the PWFT for storage or testing. Typically, as described above, the near wellbore region contains drilling mud mixed with fluids from the formation.

Before collecting a sample or running a test, a formation tester may pump the fluid in the formation to purge the mud filtrate contaminates that may have invaded the near wellbore region. Fluid sensors may monitor fluid properties during pumping. Commonly used sensors may measure resistivity, capacitance, optical absorption and magnetic resonance (hydrogen index). These measured properties may be used to evaluate sample fluid properties such as the amount of contamination of a fluid sample.

Ideally, a sample with an acceptable level of drilling mud contamination is acquired before measuring some of the properties of the formation. The operator of the formation tester may choose an acceptable level before initiating the test or collection. Meeting the acceptable mud contamination level may require pumping the formation fluid for a period of time, which could vary from minutes to days. The pumping duration is a complex function of numerous properties, including properties of the formation, the formation fluid, the drilling mud, and the pump.

SUMMARY OF THE INVENTION

In general, in one aspect, this invention features a method for predicting a property of a fluid being pumped from a formation through a well. The well may have one or more associated input properties. The method may include providing one or more input properties to an artificial neural network (ANN). The ANN may be used to produce a plurality of data points, for which each data point corresponds to a predicted time sample of the property of the fluid sample.

Implementation of this invention may include one or more of the following. The plurality of data points may be analyzed to calculate a time duration for pumping of the fluid to achieve a sample quality. The ANN may be used to predict a sample quality as a function of time. The ANN may predict a time duration for pumping the fluid to achieve a sample quality. The ANN may predict pumping differential pressure as a function of time. The ANN may include a multilayer perceptron (MLP). The MLP may include at least one hidden layer. The MLP may be a fully connected MLP. The MLP may be trained with a training data set.

The method uses as inputs, one or more input conditions. The input conditions may include one or more formation properties, one or more wellbore properties, or one or more pumpout properties. Example formation properties may include permeability, porosity, permeability anisotropy, and viscosity. Example wellbore properties may include oil-based mud type, water-based mud type, overbalance, filtrate viscosity, mudcake permeability, invasion time, and invasion depth. Example pumpout properties may include maximum pumping rate, pumping rate, pump pressure differential, number of probes. An ANN may be selected based in part on a formation property, a wellbore property, or a pumpout property.

In general, in still another aspect, this invention features a method for predicting a property of a fluid being pumped from a formation through a well. The well may have one or more input properties associated therewith. The method includes acquiring a first plurality of data points by measuring a property of the fluid sample at a series of time points, and providing one or more of the input properties to an ANN. The method also includes predicting, using the ANN, a second plurality of data points corresponding to a predicted property of a fluid sample, the second plurality of data points corresponding to the property predicted at series of time points. The first and second pluralities of data points are time synchronized, compared. The inputs to the ANN may be modified if necessary until the comparison meets a threshold.

In general, in another aspect, this invention features a system for predicting a property of a fluid suitable for formation testing from a formation through a well. The well may have one or more associated input properties. The system may include a formation tester, and a computer operably connected to the formation tester. The computer may include a module, which is configured to provide one or more input properties to an ANN; and receive from the ANN a plurality of data points, each data point corresponding to a predicted time sample of the property of the fluid sample. The system may be used with one or more packers. The one or more packers may be used to isolate an interval of a well for formation fluid collection.

In general, in another aspect, this invention features a system for extracting a fluid suitable for formation testing from a formation through a well. The well may have one or more associated input properties. The system may include a formation tester and a computer operably connected to the formation tester. The formation tester may include a chamber configured to collect the fluid. The computer may include a module, which is configured to provide one or more input properties to an ANN, predict a time duration using the ANN for pumping the fluid to achieve a sample quality; and send a signal to the formation tester, the signal including a pumping duration, the pumping duration causes the chamber to collect the fluid sample.

In general, in another aspect, this invention features a system for extracting a fluid suitable for formation testing from a formation through a well. The well may have one or more associated input properties. The system may include a formation tester and a computer operably connected to the formation tester. The formation tester may include a chamber configured to collect the fluid and a measuring section configured to measure one or more properties of the fluid. The computer may include a module, which is configured to acquire a first plurality of data points from one or more properties of the fluid sample measuring by the measuring section at a series of time points, provide one or more of the input properties to an ANN, predict, using the ANN, a second plurality of data points corresponding to a predicted property of a fluid sample, the second plurality of data points corresponding to the property predicted at series of time points, substantially time synchronize the first and second pluralities of data points, compare first and second plurality of data points that are synchronized, modify one or more of the input properties if tile comparison between the second plurality of data points and the first plurality of data points does not meet a condition; and send a signal to the formation tester causing the fluid sample to be collected by the chamber.

Other features and advantages will become apparent from the description and claims that follow.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DESCRIPTION OF PREFERRED EMBODIMENTS

Figure 1A:
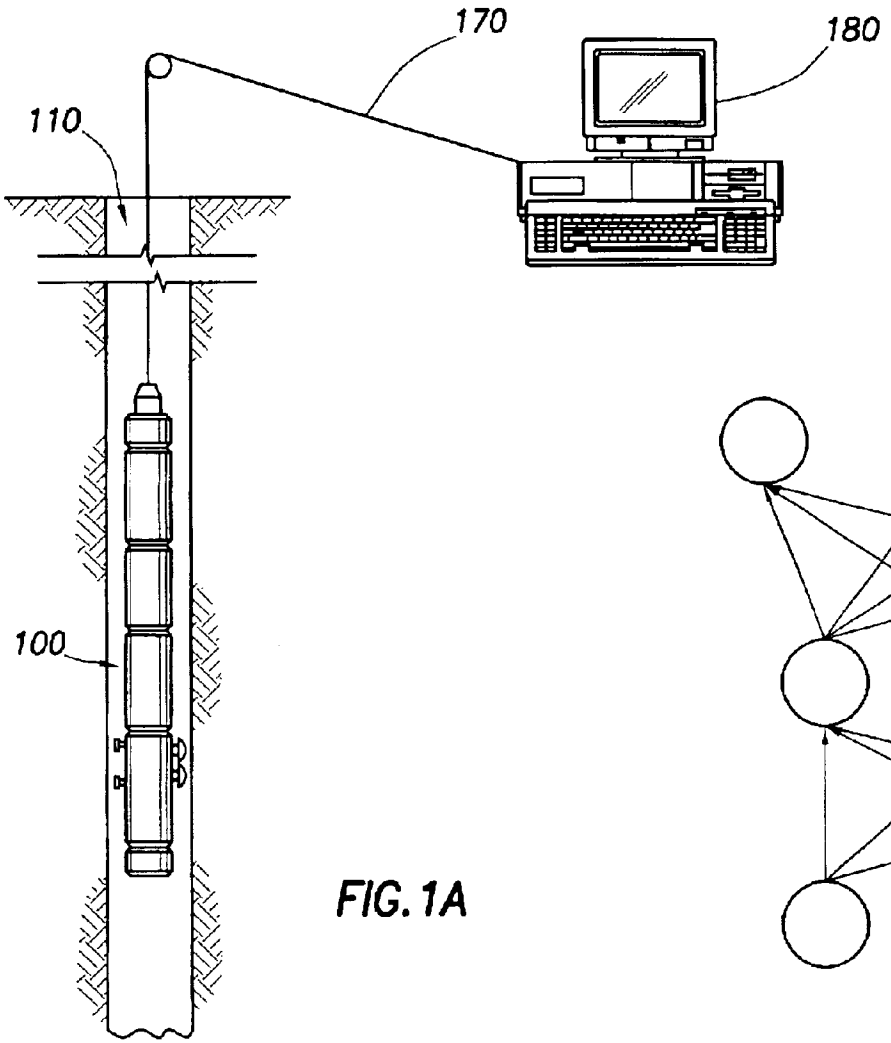
FIG. 1A is a diagram of a computer controlled formation tester for predicting properties of a formation fluid.

One implementation of a system for predicting a property of a fluid sample from a formation is shown in FIG. 1A. The system includes a formation tester 100 placed in a wellbore 110 to measure properties of a fluid collected from a formation. A pumpout wireline formation tester may be used as the formation tester. In addition, a computer 180 or other device is coupled to formation tester 100 through an interface 170. The computer 180 may be on the surface as shown in FIG. 1A, or it may be in the wellbore near or adjacent to the formation tester 100.

In another example, computer 180 need not be coupled to formation tester 100. Instead, data may be entered into the computer, and the computer may include a module or simulator to predict properties of a fluid from a formation. Alternatively, data may be entered directly into a module or simulator divorced from a computer and the module or simulator may be used to predict properties of a fluid from a formation. In still another example computer 180 may be located in the tool. For example, a module or simulator for simulating a property of a formation fluid may be implemented in a logging while drilling (LWD) format. In this example, the simulator may transmit data, such as the pumping time required to produce a pristine sample, to an operator.

The interface 170 may have mechanical, electrical, and/or acoustic properties. For example, this formation tester 100 may be suspended from the surface by a cable. Alternatively, if the formation tester 100 is a measurement while drilling (MWD) or logging while drilling (LWD) tool, it may be part of a drill string extending to the surface. The formation tester may communicate with the surface via electronic signals, through a wire or radio frequency signals, or through an acoustic telemetry system, such as a mud pulse telemetry system.

Figure 1B:
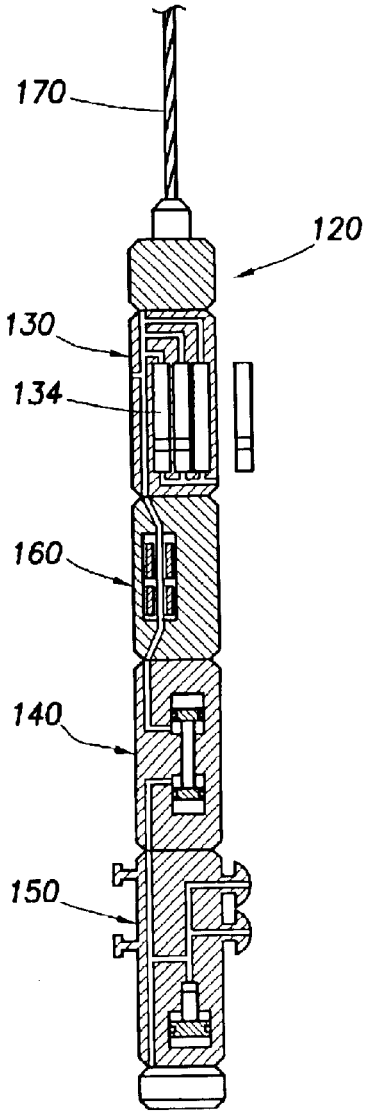
FIG. 1B is a diagram of a formation tester shown in FIG. 1A.

As shown in FIG. 1B, formation tester 100 may include multiple sections, and each such section may perform one or more functions. Formation tester 100 may perform mechanical functions such as fluid pumping or fluid sampling or physical functions such as measuring physical properties of a fluid sample or formation. The sections of formation tester 100 may be electrically, optically, and/or mechanically coupled together. The specific segments that comprise the formation tester 100 may be dependent on the properties of the fluid in the formation to be tested. Further, the formation tester 100 may be coupled to other wireline tools.

In one example system, formation tester 100 may collect fluid from a formation at a particular time and save it for later analysis. In another example system, formation tester 100 may include sensors to measure properties, such as resistivity, capacitance, impedance, optical absorption and hydrogen content of a fluid sample from a formation. To collect formation fluid samples, formation tester 100 may be placed in a wellbore until it is in close proximity to the formation to be tested. One or more probes are then extended from the tool until it seals against the wellbore. Formation fluid may be pumped from the formation through the probe into formation tester 100 and selectively collected. Furthermore, formation tester 100 may be controlled remotely by computer 180. Computer 180 may contain software that controls the operation of formation tester 100.

The example formation tester 100 depicted in FIG. 1B includes six sections. Other examples may have different number of sections. A power telemetry section (PTS) 120 is included in the formation tester shown in FIG. 1B. The PTS 120 conditions the power provided to the various sections of the formation tester. PTS 120 may also communicate with computer 180 by telemetry. Each tool section may also communicate with the computer independently but they all depend on the PTS 120 for power.

The formation tester may also include more or more multichamber sections (MCS) 130. MCS 130 may include one or more chambers 134 to collect fluid samples from, for example, a formation. In one example, the MCS includes three sample chambers 134, each sample chamber may be configured to collect approximately one liter of fluid. Pumping section 140 may pump fluid from a formation into the formation tester 100 and into sample chamber 134. Multiple chambers facilitate the testing of fluid samples from different "zones" or depths below the surface.

A flow control pumpout section (FPS) is shown in FIG. 1B as one example of pumping section 140. The pumping section 140 moves fluid through formation tester 100. As with other sections of formation tester 100, the pumping section 140 is not required to be in one particular location within the formation tester 100, but may be placed anywhere within the formation tester. The FPS is normally positioned between a probe section 150 and MCS 130 so that the fluid drawn into the probes can be pumped to the chambers 134. If the FPS is not positioned between the probe section 150 and MCS 134, the formation can be pumped, but the chambers will be filled by the natural fluid drive of the formation into an atmospheric chamber.

In some implementations, controlling the flow rate may be desired. In one embodiment, FPS 140 may pump fluid at a rate exceeding one gallon per minute at a pressure of 500 psi and a maximum pressure differential of 4,000 psi. In another embodiment, FPS 140 may have interchangeable pump pistons enabling a pumping pressure differential of about 4,000–6,000 psi. For a more precise flow rate control, FPS 140 may also include a feedback control system. The feedback control system may control the pumping rate based on control properties such as an operator-specified rate, pressure and fluid property variations.

Probe section 150 may be attached to the formation tester 100 to measure pressures and properties of the fluid pumped through formation tester 100. Probe section 150 may include one or more probes to extract fluid from the reservoir. Formnation tester 100 shown in FIG. 1B depicts a dual probe section (DPS) 150 in which each probe includes a strain gauge that independently measures pressures at each respective probe. Additionally, probe section 150 may also include one or more optical, resistive, or dielectric sensors to measure fluid properties, such as resistivity, impedance, and capacitance. These sensors need not be located in probe section 150, but may be placed elsewhere within the formation tester.

In addition to measuring fluid properties within probe section 150, formation tester 100 may also include a measuring section 160. One such example of measuring section 160 is a downhole nuclear magnetic resonance fluid analyzer. A magnetic resonance-based section measures such parameters as viscosity, gas-oil ratio, and hydrogen index.

The properties measured by the formation tester 100 can be used to predict contamination of the formation fluid. The fluid pumped initially by formation tester 100 may include drilling mud. It may be desirable to sample the fluid collected by formation tester 100 in the absence of drilling mud in order to collect a pristine formation fluid sample. A pristine fluid sample includes a mixture of fluid and contaminants, e.g., drilling mud, in which the contaminants do not exceed a particular threshold. Acquiring a pristine sample may require pumping fluid through formation tester 100 until the amount of contamination of formation fluid is below a chosen threshold. It is frequently useful to know the length of time necessary to pump before a pristine sample can be taken. For example, the amount of contamination considered acceptable may be adjusted if the pumping time is too long. A long pumping time is not only more costly, but also may increase the possibility that the well may suffer damage such as a blow out.

Figure 2:
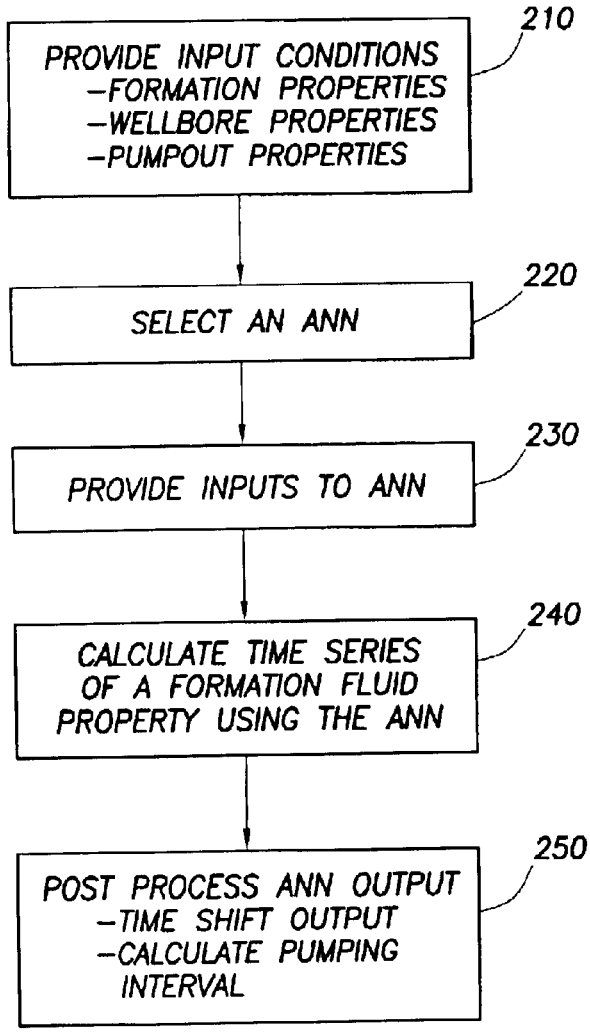
FIG. 2 is a flow diagram for predicting one or more properties of fluid sample from a formation.

FIG. 2 shows one example system to predict the time duration required for the formation tester 100 to pump fluid a pristine fluid sample from a formation to collect a pristine fluid sample. The particular threshold may be chosen to be any number in the range of 0 and 100 percent (of contaminant per fluid volume), but preferably the threshold is set to less than fifteen percent.

Multiple input conditions are provided to an example system (block 210). The input conditions may be used to select the type of ANN (block 220) and to condition the output of the selected ANN. The input conditions may also function as inputs to an ANN. The numeric values of the input conditions may correspond to formation properties, wellbore properties, or pumpout properties. Example formation properties include pressure (psi), bubble point pressure (psi), horizontal permeability (Kh), permeability anisotropy, porosity, and oil viscosity (cp).

Example wellbore properties include drilling mud type, overbalance (psi), filtrate viscosity (cp), mudcake permeabilty (md), invasion time (days), and invasion depth (ft). The type of drilling mud is typically either oil-based mud or water-based mud. Overbalance is a measure of the excess pressure of the drilling mud outside the formation compared to the pressure of the fluid in the formation.

Example pumpout properties include maximum pumping rate (cc/sec), pump pressure differential (psi), and number of probes. The number of probes refers to the number of probes in the DPS sections 150 that collect or measure fluid data For example, assuming the use of a dual probe segment, the number of probes may be one (in which case one of the probes is idle) or two in another example, the number of probes may be increased by increasing the number of DPS sections 150. Additionally, other probe designs can be specified that may increase surface area to further increase the pumping rate. In one example, straddle packers may be used with a formation tester to increase the wellbore surface area. Straddle packers may be incorporated as an input parameter.

Some of the input parameters may be used to select an ANN (block 220). In a preferred embodiment, an ANN may be selected based upon three conditions: the number or types of probes, the type of drilling mud, and a desired predicted property (e.g., sample quality or pumping differential pressure). Assuming two choices exist for the number of probes, two choices exist for the type of mud, and two choices exist for the predicted properties, these three conditions may be used to select one of eight trained ANNs to predict a desired property. In still another implementation, the type of drilling mud and number of probes may be used as inputs to one ANN. In this case, two instead of eight trained ANNs are used to predict a property of a formation fluid.

Once an ANN has been selected, input values are provided to the ANN (block 230). In one example system, the inputs to the ANN include the following formation properties: permeability, porosity, permeability anisotropy, and viscosity ratio. Preferably, the permeability is the horizontal permeability (Kh) and the permeability ratio is the ratio of the vertical permeability to the horizontal permeability. Alternatively, the permeability may be chosen to be the vertical permeability (Kv). Viscosity ratio may be determined from the ratio of the formation fluid viscosity and the mud filtrate viscosity.

Once the input parameters are provided to select the ANN, the selected ANN calculates the predicted time series of values for a formation fluid property (block 240). The predicted fluid property may include sample quality or pumping differential pressure. A sample quality curve reflects the amount of contamination in a formation sample as a function of time. As described above, the pumping of fluid by formation tester 100 over time removes drilling mud that infiltrated the formation during drilling. Consequently, the amount of mud contamination present in fluid samples taken over a period of time typically decreases as reflected in a sample quality curve.

A pumping differential pressure curve depicts the pumping differential pressure as a function of pumping time. Preferably, the pumping differential pressure is the pressure difference between the pressure in the formation initially measured by the formation tester and the pumping pressure measured as a function of time. Alternatively, the pumping differential pressure is the pressure of one of the probes (if more than one probe is being used) measured relative to atmospheric pressure. In still another alternative, the pumping differential pressure is the pressure difference measured by both probes' formation tester 100 where one probe measures the pumping differential pressure and the second probe measures the differential pressure that propagates from the pumping probe.

Some of the inputs to the system may be used to scale the predicted time series of a property of the formation fluid (block 250). For example, the time associated with a predicted data series may be scaled according to the following equation:

$$\alpha = \frac{q_T}{q} * \left(\frac{v}{v_T}\right)^2,$$

where $q_T$ and $v_T$ are the pumping rate, and drilling mud filtrate invasion volume, respectively, associated with the training data, q is the pumping rate associated with the formation tester, and v is the mud filtrate invasion volume associated with the formation. For example, if the drilling mud filtrate invasion volume v equals the mud filtrate volume associated with the training data $v_T$, and if the pumping rate of the formation tester q is twice that associated with the training data $r_T$, then the time domain for the output of the ANN will be one half that of the training data, i.e., the pumping time will be one half of the training case.

The maximum pumping rate for a given set of conditions is dependent not only on the formation properties but on the performance of the FPS pump. The FPS pump performance can be estimated using the following equation:

$$Q_{\max} = Q_{fps}\left(1 - \frac{\Delta P_{\max} + \Delta P_{hf}}{\Delta P_{fps}}\right)$$

where:

$Q_{max}$=maximum flow rate that can be obtained under current formation conditions;

$\Delta P_{max}$=maximum pressure differential that can be obtained under current formation conditions;

$Q_{fps}$=maximum FPS pumping rate at 500 psi pressure differential;

$\Delta P_{fps}$=maximum FPS pressure differential at 0 cc/sec rate;

$\Delta P_{hf}$=($P_{hyd-Pf}$), is the pressure difference between hydrostatic pressure and formation pressure; $\Delta P_{hf}$ is the drilling mud overbalance, which in an example system has a default value of 500 psi); and $P_f$=the pressure just before pumping starts, which in an example system has a default value of $P_p$ is 10,000 psi.

The formation properties also determine a relationship between the Qmax and $\Delta P_{max}$. Assuming single-phase incompressible spherical Darcy flow, the following equation applies:

$$Q_{\max} = \Delta P_{\max} \frac{2\pi n r_p}{C_p} \frac{k_h \sqrt[3]{\lambda}}{\mu}$$

where;

$k_h$=horizontal permeability;

$\mu$=maximum viscosity;

$C_p$=probe geometric factor;

$r_p$=probe radius;

$n_p$=number of closely spaced probes;

$\lambda$=anisotropy, vertical to horizontal permeabilty ($k_v/k_h$).

Solving these two linear equations simultaneously yields $\Delta P_{max}$ and $Q_{max}$. Moreover, the sample conditions can place a further limitation of the $Q_{max}$. Because it is desirable to pump a single phase sample, the pumping pressure should be maintained above the bubble point pressure. The bubble point pressure can be determined from previous samples from a reservoir or a fluid sensor in the PWFT. This criterion can be defined as follows:

$\Delta P_{max} \leqq P_f - \Delta P_{bp}$ where:

$P_{bp}$=bubble point pressure (in an example system, the default is 0 psi);

In one example, the maximum pumping rate is a function of the PWFT tool configuration and limitations (i.e., $Q_{fps}$, $P_{fps}$, n probes, $r_p$, and $C_p$), and the formation conditions ($P_f$, $P_{hf}$, $P_{bp}$, $k_h$, $\mu$, $\lambda$). Here, the maximum flow rate $Q_{max}$ is estimated by the following set of equations:

$$\text{If } \Delta P_{\max} = \frac{\Delta P_{fps} - \Delta P_{hf}}{\frac{\Delta P_{fps}}{Q_{fps}} \frac{2\pi n r_p}{C_p} \frac{k_h \sqrt[3]{\lambda}}{\mu} + 1} > (P_f - P_{bp})$$

$$\text{Then } P_{\max} = (P_f - P_{bp})$$

$$\text{Else } \Delta P_{\max} = \frac{\Delta P_{fps} - \Delta P_{hf}}{\frac{\Delta P_{fps}}{Q_{fps}} \frac{2\pi n r_p}{C_{dd}} \frac{k_h \sqrt[3]{\lambda}}{\mu} + 1}$$

$$\text{Now solving for } Q_{\max}\text{: } Q_{\max} = \Delta P_{\max} \frac{2\pi n_p r_p}{C_{dd}} \frac{k_h \sqrt[3]{\lambda}}{\mu}.$$

The maximum flow rate $Q_{max}$ may determine a pumping rate to be used as an initial input to the sample quality (pumpout) ANN. In one embodiment, any pumping rate can be specified. Limitations on the pumping rate may affect system performance or system output For example, the Simulator shown in FIGS. 4A and 4B (discussed infra) use the maximum pumping rate but a lower pumping rate may be specified. In an alternative version of the simulator a variable pumping rate schedule could be used to optimize the pumpout performance. For example, if the filtrate has a lower viscosity than the oil in the formation, the pump could be started at a higher rate and adjusted based on the viscosity for the mixed filtrate and oil. The pumping rate of an oil based mud system may be based on a viscosity mixing law. The pumping rate of a water based mud system may be based on the relative permeabilities of the formation. Additional pumping rate criterion and scenarios may be developed by one of ordinary skill in the art.

The invasion volume is a function of the input conditions such as mud type (OBM or WBM), formation type (oil wet or water wet), invasion time, mudcake properties (i.e., permeability, compaction factor) and overbalance ($\Delta P_{hf}$). A one dimensional axisymmetric numerical invasion simulator can be used to determine the invasion front. Alternatively, an additional ANN model can be used to predict the invasion front. In a preferred embodiment, a computational efficient one dimensional numerical simulator is used. A prediction of the invasion front reduces the number of training sets needed for an ANN model to predict fluid properties and increases the overall performance and accuracy of the system. The invasion depth can be defined as a function of invasion volume and the saturation profile of the filtrate from the wellbore. Invasion depth can be defined as the distance from the wellbore that the filtrate saturation reaches a minimal volume fraction. This is typically 20% or about 80% of the total volume.

In one example system, the pumpout or sample quality ANN models may be developed based upon invasion depth associated with an invasion volume. An invasion depth is initially predicted using an axisymmetric simulator. This initial invasion depth prediction may be used in a full 3D invasion model to predict fluid properties. In one example, the invasion depth determined by a one dimensional axisymmetric numerical invasion simulator may be used as an input to the pumpout sample quality ANN models.

Because mudcake growth can be considered axisymmetric, a cylindrical one dimensional model can be used. An example of a cylindrical (e.g., radial) axisymmetric mud cake growth modeled as a function of time may be given by the following equation:

$$\frac{1}{2}\left(\frac{r_{mc}}{r_{ext}}\right)^2\log\left(\frac{r_{mc}}{r_{ext}}\right)-\frac{1}{4}\left(\frac{r_{mc}}{e_{ext}}\right)^2+\frac{1}{4}=t\lambda\frac{k_{mc}}{\mu}\frac{\Delta P_{mc}}{r_{mc}},$$

where $r_{mc}$ is the radius of the mudcake, $r_{ext}$ is the radius from the center of the mudcake to the fluid external from the boundary of the mud cake, $k_{mc}$ is the mud cake permeability, $\mu$ is the filtrate viscosity, and differential pressure acting on a mudcake ring is $\Delta P_{mc}=P_m-P_w$ where $P_m$ is the mud pressure and $P_w$ is the pressure behind the mudcake at the wellbore interface.

An expression for immiscible radial darcy flow in terms of total production per unit volume per unit time (q(t)) is given by the following equation:

$$-\frac{\partial}{\partial r}\left[\frac{k_{nw}}{\mu_{nw}}\frac{\partial P_c(S_w)}{dr}+\left(\frac{k_{nw}}{\mu_{nw}}+\frac{k_w}{\mu_w}\right)\frac{\partial P_w}{dr}\right]=\frac{q(t)}{r}, \qquad \text{(Equation 1)}$$

where $S_w$ is the wetting saturation, $P_w$ is the wellbore pressure, $P_c$ is the capillary pressure, $\phi$ is the porosity, the non-wetting and wetting permeabilities are ($k_{nw}$, $k_{nw}$), and the non-wetting and wetting viscosities are ($\mu_{nw}$, $\mu_{nw}$).

From these two expressions a finite difference model can be developed that couples the mudcake growth model to a reservoir model simulating mud filtrate invasion. A full 3D reservoir model can also be developed using the same methods illustrated here. In another example system, a miscible finite difference model can be developed to simulate oil-based mud invasion in an oil zone, where mudcake growth is coupled to the reservoir model.

Using the radial invasion model the initial conditions prior to the sampling process may be estimated or calculated. The mudcake thickness and permeability may be predicted as well as the relative saturations in the near wellbore region. These initial conditions may be applied to a full 3D model that simulates the asymmetric flow of fluid into formation tester probes. These initial conditions may also be generalized as a characteristic invasion depth or volume to simplify the training sets needed for the ANN model.

If the assumption is made that $\Delta P_{mc}$ is constant, another example solution to the mudcake growth model may be given by the following equation:

$$\Delta r_{mc}=r_{ext}\sqrt{2t\lambda\frac{k_{mc}}{\mu}\frac{\Delta P_{mc}}{r_{mc}}}$$

This expression may be used in conjunction with a reservoir model (see equation (1)) to estimate the invasion saturation profile. In this case the mudcake growth is decoupled from the reservoir model.

Using the scaling factor a given previously, the sizes of the training data set may be reduced. In this case, the training sets can be run at a single flow rate q, and the pumping times may be subsequently scaled by $\alpha$. For example, if the invasion volume is determined to be v, the pumpout ANN model determines a sample quality time sequence using q. $Q_{max}$ is determined and substituted as $q_T$, and the time scaling factor $\alpha$ is calculated to scale time pumping times. To further reduce the size of the training set all of the ANN models can be run at a typical initial invasion depth or volume.

In another example, the invasion depth and flow rate may be predicted from an additional ANN. Specifically, an ANN is trained using a set of invasion depth results using a 3D model by applying the axisymmetric invasion results to a 3D model as described previously. An 1-D axisymmetric finite element method is used to predict the level of invasion and the invasion depth is used as an input to this ANN to predict an invasion depth. The invasion depth is then used to scale the predicted output of the system.

Additional systems may be developed based upon other simplifications. For example, for OBM the viscosity ratio is the primary determining factor for the sample quality curve. Using this simplification the filtrate viscosity can be held constant while the formation viscosity is varied. The flow rate is determined based on the maximum viscosity, and the previous scaling factors are applied. Other simplifications could potentially be determined by those skilled in the art.

One system to predict a sample quality of a fluid from a formation uses an ANN to predict a sample quality curve (or differential pumping pressure curve) as a function of time. Alternatively, a desired sample quality may be selected (e.g., desired level of drilling mud contamination), and the output of the ANN may be analyzed to determine the pumping time necessary to meet the desired sample quality (block 250). For example, the series of data points predicted by the ANN may be interpolated to determine the pumping time necessary to achieve the desired sample quality.

Figure 3:
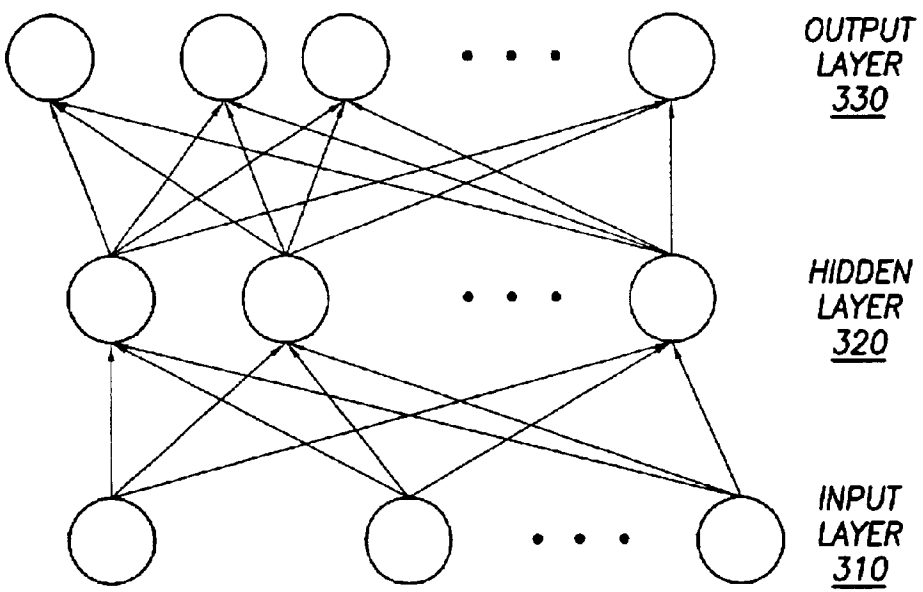
FIG. 3 depicts a multilayer perceptron.

Various types of ANNs may be used to predict pumping time required to achieve a desired sample quality. Any type of suitable ANN can be used. For example, FIG. 3 shows a preferred multilayer perceptron (MLP) as the ANN. An MLP may include an input layer 310, a hidden layer 320, and an output layer 330. An MLP may be a fully connected MLP, in which each input node is connected to each node of the hidden layer, and each node of the hidden layer is connected to each node of the output layer as shown in FIG. 3.

In one example system, input layer 310 of the ANN includes four nodes, corresponding to permeability, porosity, permeability anisotropy, and viscosity ratio, respectively. Hidden layer 320 of the ANN includes ten nodes. The output layer 330 of the ANN includes forty nodes, and the output from the forty nodes is a predicted time series of sample quality or pumping differential pressure. Each output node corresponds to a particular time point of the predicted time series. In the example system, time points are logarithmically (base 10) distributed so that the 40 output nodes correspond to a time duration spanning four orders of magnitude of 10.

An ANN used in the disclosed systems and methods is not limited to the architecture shown in FIG. 3. The number of inputs to the ANN may be more or less than four. Moreover, the number of hidden layers may be one or more. The number of nodes in the hidden layer may be more or less than ten. Furthermore, additional output nodes may be included, such as a prediction of the pumping time required to achieve a desired ample quality. For a single probe ANN, the pressure differential propagating to the second probe could be predicted. Additionally, the predicted time period may be greater or less than four orders of magnitude. The ANN may include more or less than 40 output nodes.

In still another alternative approach, an ANN may be used to predict directly the pumping time required to achieve a desired sample quality. For example, an additional output node corresponding to a pumping time may be added to the ANN. In another implementation, the ANN may be constructed with a single output node corresponding to the pumping time required to achieve a desired sample quality.

An ANN is typically trained before it is used to predict formation properties. In the example system shown in FIG. 3, which uses a fully connected MLP, the connections between nodes may be described by numeric values or "weights." The value at any particular node in an MLP is equal to the sum of the product of each weight and corresponding node in a preceding layer that is connected through that weight to that particular node. The weights of the MLP are adjusted during a process known as "training."

In one example system, a training data set is used to adjust the weights of the ANN. A training data set typically includes multiple rows, and each row includes multiple fields. Each field corresponds to an expected input to, or an expected output of the ANN. For a given row of the training data set, the values of the input fields are provided to the ANN, and the ANN calculates a series of outputs. The calculated series of outputs are compared with the expected output from the output fields of the training data set. Based upon this comparison, the weights of the MLP are adjusted to reduce the error between the output predicted by the ANN and expected output of a corresponding row of the training data set. The input fields of each row of the training data set are repeatedly applied to the ANN, and the ANN weights are correspondingly adjusted. In an alternative example, the input and output fields may be stored in one or more training data sets.

A training data set preferably should contain sufficient data entries such that the training data set statistically approximates both the expected input and the expected output of the ANN. Preferably, at least 500 data entries are included in the training set. The training data set may include data that is generated by commercially available software. In one example system, the VIP™ software package from Halliburton Energy Services Group generates the training data. To enhance the training algorithm, noise may be added to the training data set. In one implementation, random Gaussian noise, between 0 and 2%, may be added to the training data set to test its sensitivity and determine if the training set is adequate.

In an alternative example, the training data set may also include data that is measured or estimated from data measured by formation tester 100. For example, formation tester 100 may include measuring section 160, which may include a magnetic resonance imaging section or MRI. The devices may measure hydrogen content, which in turn, may be used to estimate formation properties such as sample quality. Using these measured parameters may enhance the training of an ANN by including in the training set data that may include properties introduced by formation tester 100 and not adequately modeled by the software that generated the training data set.

In one example system, the neural network is trained using a back propagation algorithm. One representative training algorithms includes a quasi-Newton nonlinear training algorithm. For example, the Broyden, Fletcher, Goldfarb, and Shanno (BFGS) algorithm, incorporated in the BFGS function included in the software package Matlab, may be used. Other neural network training algorithms may be used without limitation.

Figure 4A:
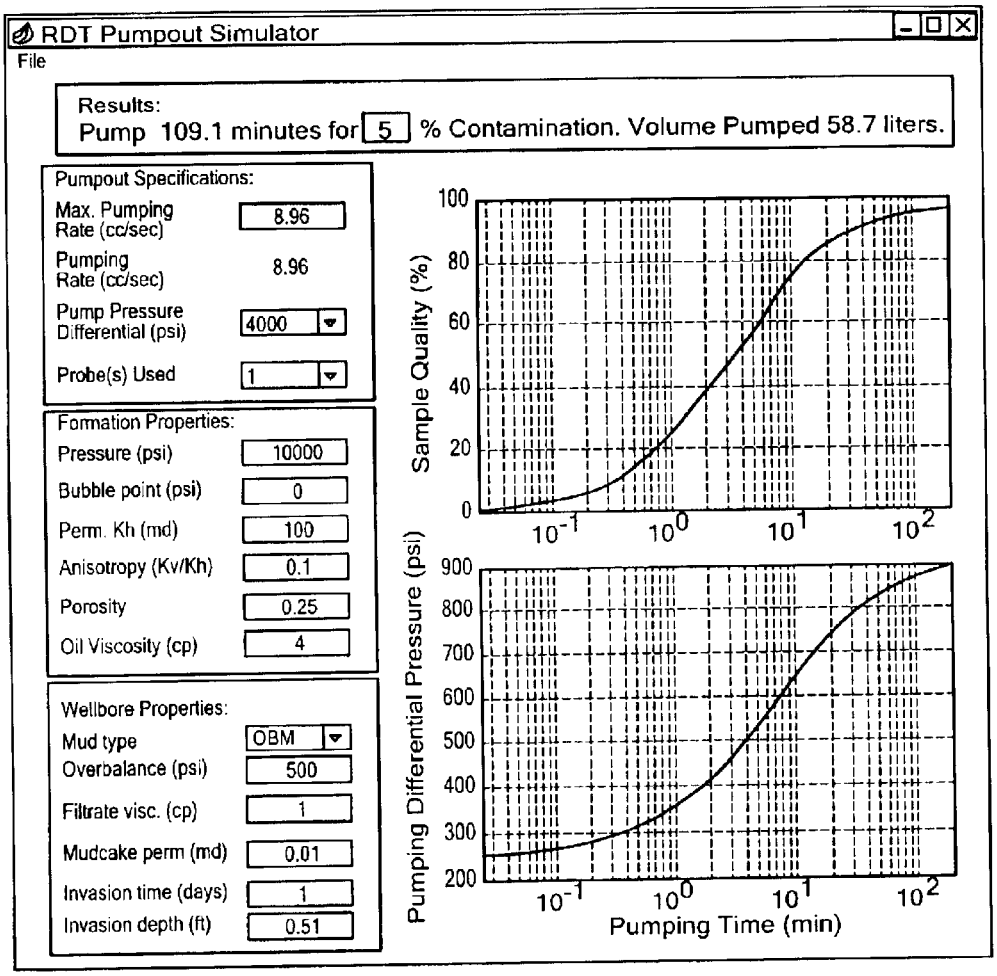
FIG. 4A shows representative sample quality and pumping differential pressures from one example system.

An output of one example system to predict the pumping time of a fluid sample to achieve a desired sample quality is shown in FIG. 4A. A 5% drilling mud contamination level was chosen (desired sample quality of 95%). The following pumpout properties were chosen or calculated: 8.96 cc/sec maximum pumping rate, 8.96 cc/sec pumping rate, 4000 psi pump pressure differential, and one probe. The following formation properties were chosen or calculated: 10,000 psi formation pressure, zero bubble point pressure, 100 md permeability, 0.1 anisotropy, 0.25 porosity, and 4 cp oil viscosity. The following wellbore properties were chosen or calculated: oil-based mud type, 500 psi overbalance, 1 cp filtrate viscosity, 0.01 md mudcake permeability, 1 day invasion time, and 0.51 foot invasion depth. Using these parameters, a pumping time of 109.1 minutes was predicted to obtain a 5% contamination level, resulting in a volume of 58.7 liters pumped.

Figure 4B:
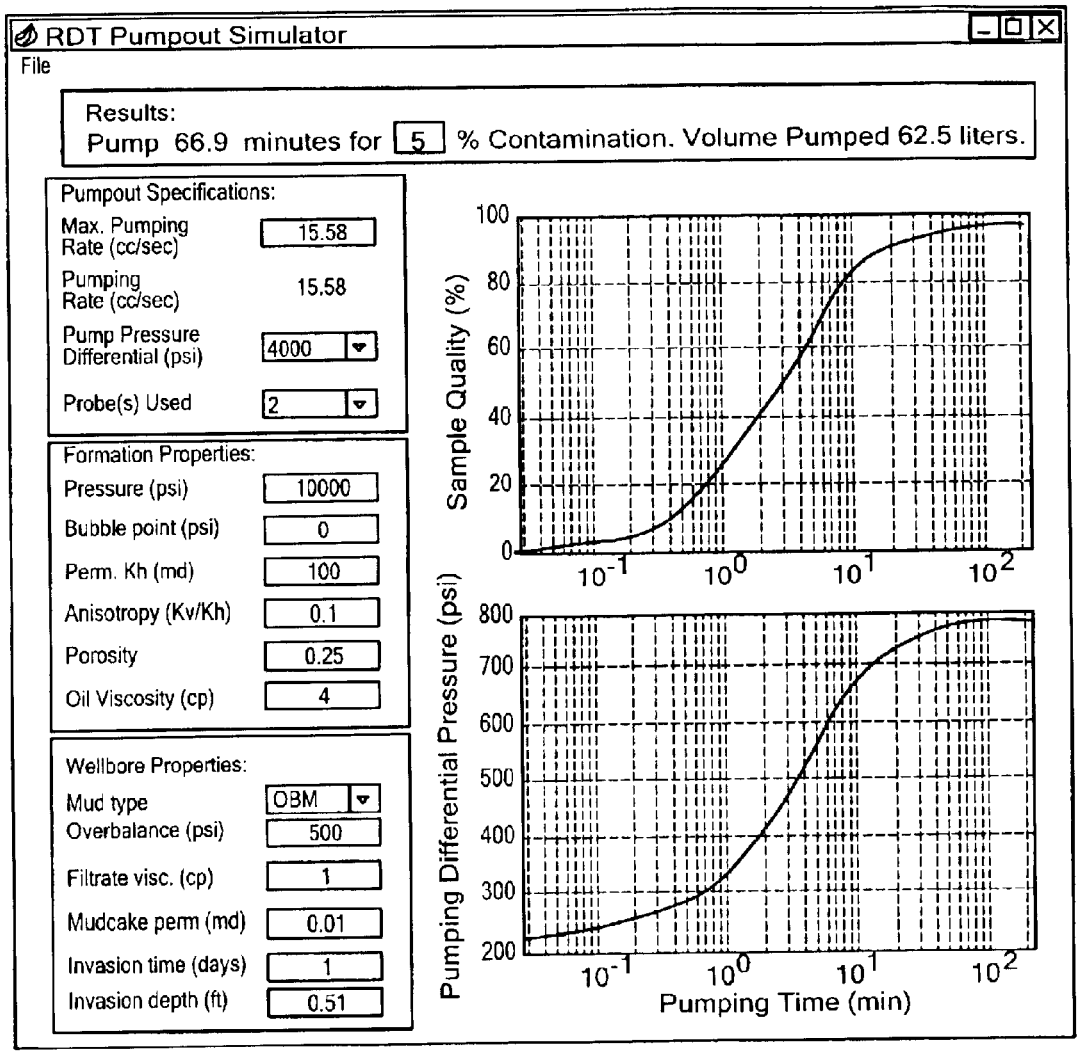
FIG. 4B shows representative sample quality and pumping differential pressures from another example system.

In FIG. 4B, the number of probes was doubled to two, increasing the maximum pumping rate to 15.58 cc/sec. Under these conditions, the predicted pumping time to reach a 5% fluid contamination was reduced to 66.9 minutes, resulting in a volume of 62.5 liters of fluid pumped. While a maximum pumping rate as determined by $Q_{max}$ may be used, a lower value can be entered to determine the effect it has on pumping time of the system.

Figure 5:
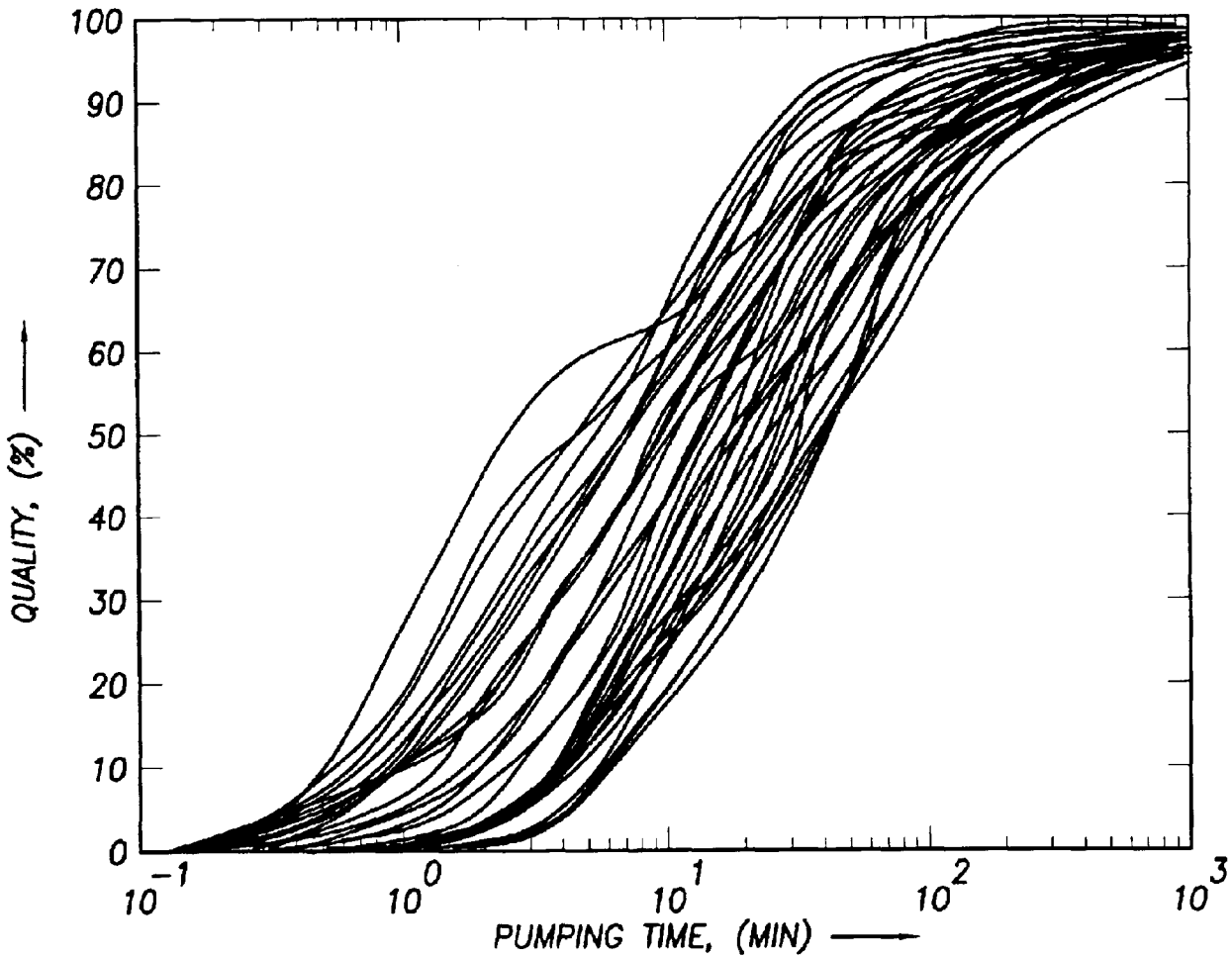
FIG. 5 shows a family of sample quality curves predicted from one example system.

FIG. 5 shows a family of sample quality curves generated by an example ANN for an oil-based drilling mud system. The family of curves in FIG. 5 was calculated by varying the following parameters among the values shown:

| | |
|---|---|
| Viscosity Ratio: | 0.5, 1.0, 2.0, 4.0 |
| Formation horizontal permeability: | 1000 md, 100, md, 10 md |
| Permeability anisotropy: | 0.01, 0.1, 1.0 |
| Porosity: | 0.15, 0.25, 0.35 |

The remaining input parameters for the example shown in FIG. 5 were chosen to be equal to the corresponding input parameters of the example shown in FIG. 4A.

Figure 6A:
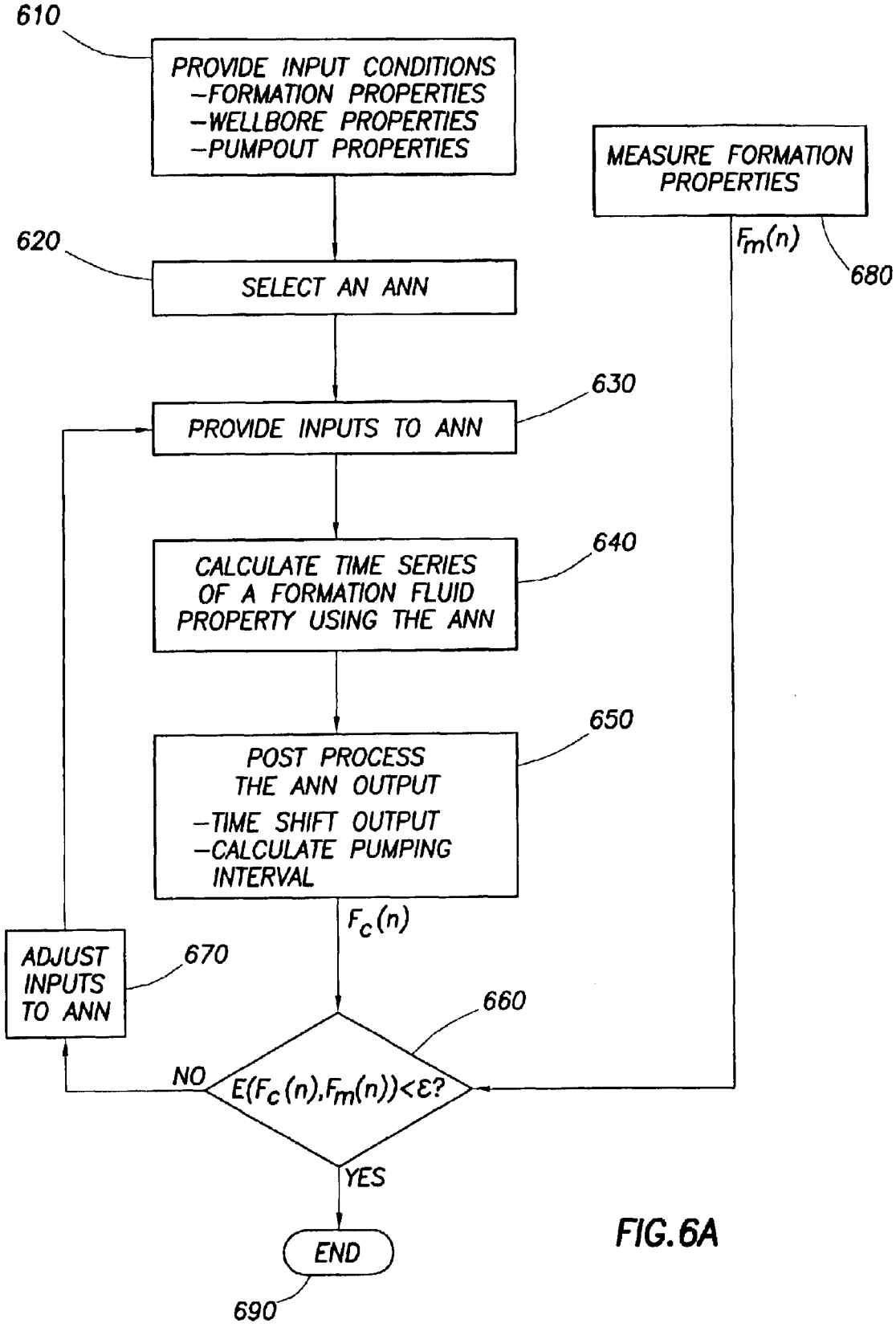
FIG. 6A shows a flow diagram for predicting a time required for pumping based in part on a comparison between a predicted fluid property with a measured fluid property during pumping.

In another example system, the properties measured by formation tester 100 during pumping may be used to enhance the prediction of selected fluid properties. Such a system would perform two parallel functions, as shown in FIG. 6. In the first function, an ANN calculates a series of data points corresponding to either sample quality or pumping differential pressure. This ANN functions as described with respect to FIG. 3. In the second function, formation properties measured from the formation are compared with the data predicted by the neural network.

Describing the first function, input conditions (e.g., formation parameters) are provided to the system as shown in block 610. As described above with respect to FIG. 2, some input conditions are used to select an ANN (block 620), some input conditions are used as inputs to select an ANN (block 630), and some input conditions are used during post-processing of the ANN output (block 650). The ANN calculates a time series of a formation property (block 640). A formation property may include sample quality or pumping differential pressure as a function of time. In one example system, the time series may logarithmically distributed and encompass four orders of magnitude of time. In still another example system, the time series may encompass five or more orders of magnitude of time.

The selected neural network may calculate a data set corresponding to a predicted time series of a property of the fluid sample from the formation at block 640. The data set predicted by the neural network may then be compared at block 660 to the data set measured by the formation tester (block 680). To facilitate the comparison, a data set, $F_c(n)$, is generated from the output of the neural network (block 650) by interpolating time points that are substantially synchronized with the time points associated with the measured data set $F_c(n)$. Furthermore, a pumping time required to obtain a fluid sample of a desired sample quality may be calculated at block 650.

$F_c(n)$ is compared to $F_m(n)$, and an error metric, such as a least squares error metric, is calculated. The calculated error is compared against an acceptable error threshold. In one example system, if the error metric is below a threshold or a condition, the method stops (block 690). Otherwise, if the error metric exceeds a condition or a threshold, the properties that are used as inputs to the ANN are modified (block 670), and the modified properties are then used as inputs to the ANN (block 630). In one example, a Monte Carlo approach is used to modify the formation parameters at block 670.

Figure 6B:
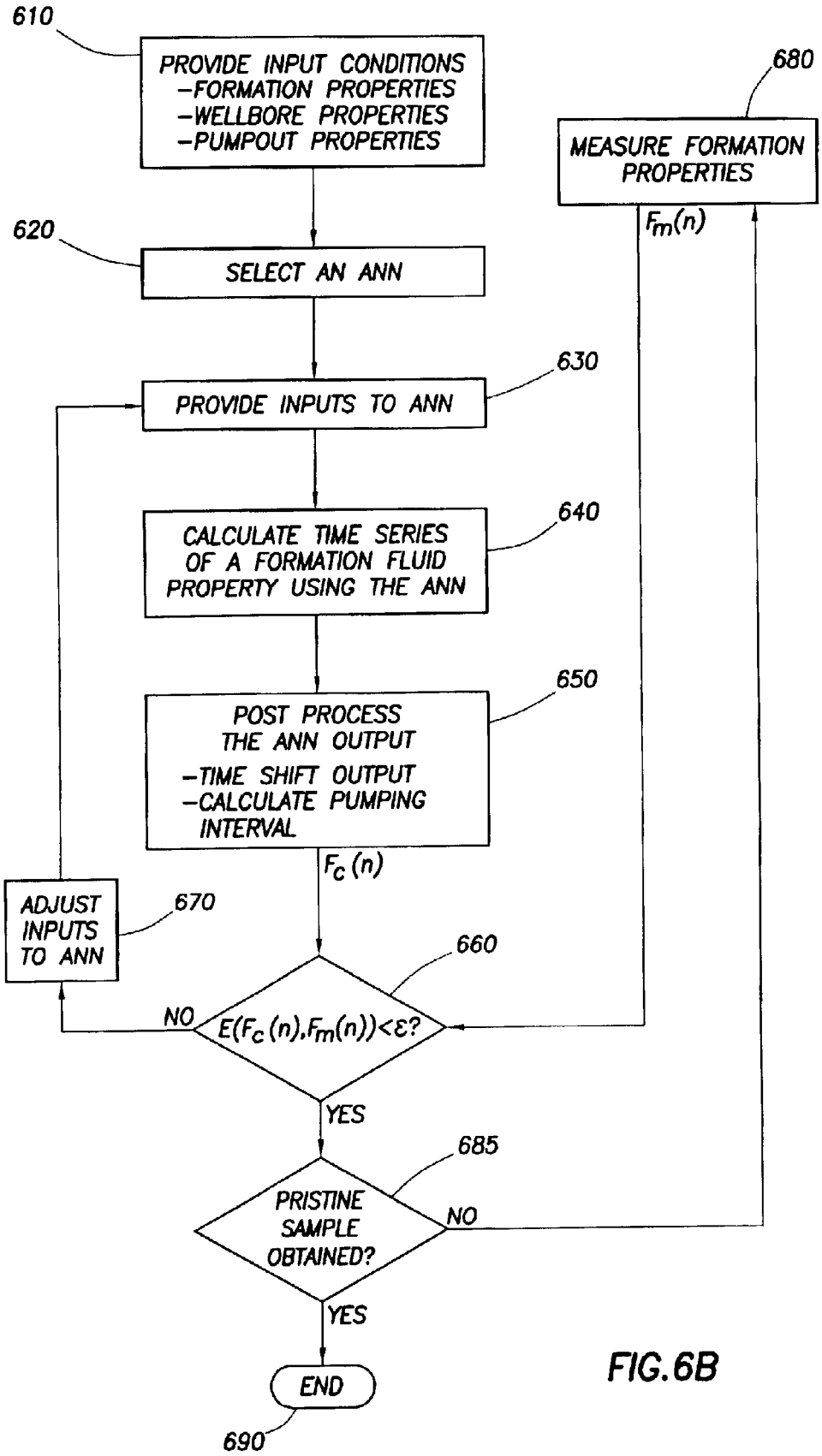
FIG. 6B shows an alternative flow diagram for predicting a time required for pumping based in part on a comparison between a predicted fluid property with a measured fluid property during pumping.

In another example depicted in FIG. 6B, the properties predicted by the neural network and those measured by formation tester are compared until a pristine sample is obtained. A pristine sample may be described by an acceptable drilling mud contamination. In this fashion, the prediction of the time duration by the ANN may be verified against the measured properties over time to obtain a pumping time duration of high confidence. The example shown in FIG. 6B is similar to that shown in FIG. 6A with an additional comparison function at block 685. In this example, the formation tester measures additional formation properties at step 680 until a pristine sample is obtained.

In still another example, a comparison between the ANN and the measured formation properties is repeated until a time threshold is met. In one example, the time threshold may be the pumping time predicted to obtain a pristine sample. In an alternative example, the time threshold may be chosen to be less than the time predicted to obtain a pristine sample.

In still another example, a packer could be used in combination with the wellbore to isolate an annular region from which to sample the formation fluid. In one example, one or more inflatable packers may be used in conjunction with a downhole tool to isolate a region within the wellbore from which a sample may be extracted and analyzed. In one implementation, two packers may be used. One packer may create a boundary that corresponds to the desired lower boundary of an annular region and another packer may create a boundary that corresponds to the desired upper boundary of an annular region from which a fluid sample may be taken. The two packers may create a seal against an open hole, and the fluid may be extracted, using, for example, a pumpout tool.

A pumpout tool having one or more probes may be used with inflatable packers as described above. In one example, the probes may be used to monitor pressures associated with the formation fluid. In another example, one or more probes may be used to calculate an anisotropy range or ratio.

This disclosure is not limited to the use of a MLP with a backpropagation algorithm. Various types of ANN may be applied to this invention. For example, a self organizing feature map may function as the ANN. In this case, a training data set may be provided to the network, and the self organizing feature map will attempt to train itself following repetitive application of the training data. Further, the disclosed invention is not limited to the embodiments disclosed. For example, one embodiment may be directed to a process control system for which input parameters may be used to adjust an output based upon a model or historical measurements. Other embodiments may include complex nonlinear systems for predicting future data based upon historical data. Examples include predicting economic outcomes or predicting molecular or chemical interactions. Additional applications include adaptive control systems and nonlinear systems having a chaotic component.

Although the present disclosure has been described in detail, it should be understood that various changes, substitutions, and alterations can be made hereto without departing from the spirit and the scope of the invention as defined by the appended claims.

What is claimed is:

1. A method for predicting a property of a fluid being pumped from a formation through a well, the well having one or more input properties associated therewith, the method comprising:

providing one or more input properties to an artificial neural network (ANN); and receiving from the ANN a plurality of data points, each data point corresponding to a predicted time sample of the property of the fluid sample.

2. The method of claim 1, further comprising receiving from the ANN the time duration for pumping the fluid to achieve a sample quality.

3. The method of claim 1, further comprising estimating a time duration for pumping the fluid to achieve a desired sample quality.

4. The method of claim 1, wherein the property of the fluid sample corresponds to a sample quality.

5. The method of claim 1, wherein the property corresponds to a pumping differential pressure.

6. The method of claim 1, wherein the input properties comprise one or more formation properties.

7. The method of claim 1, wherein at least one of the one or more formation properties provided to the ANN is selected from the group consisting of permeability, porosity, permeability anisotropy, and viscosity ratio.

8. The method of claim 1, wherein the input properties comprise one or more wellbore properties.

9. The method of claim 8, wherein the one or more wellbore properties are selected from the group consisting of oil-based mud type, water-based mud type, overbalance, filtrate viscosity, mudcake permeability, invasion time, and invasion depth.

10. The method of claim 1, wherein the input properties comprise one or more pumpout properties.

11. The method of claim 10, wherein the one or more pumpout properties are selected from the group consisting of maximum pumping rate, pumping rate, pump pressure differential, number of probes.

12. The method of claim 11, wherein the number of probes is one or more.

13. The method of claim 1, further comprising:

selecting the type of ANN based in part on a formation property.

14. The method of claim 1, further comprising:

selecting the type of ANN based in part on a wellbore property.

15. The method of claim 1, further comprising:

selecting the type of ANN based in part on a pumpout property.

16. The method of claim 1, further comprising:

modifying the plurality of data points based in part on one or more properties selected from the group consisting of a formation property, a wellbore property and a pumpout property.

17. The method of claim 1, wherein the ANN further comprises a multilayer perceptron.

18. The method of claim 17, wherein the multilayer perceptron includes at least one hidden layer.

19. The method of claim 1, wherein the ANN further comprises:

an input layer, the input layer including one or more input nodes;

a hidden layer, the hidden layer including one or more hidden nodes, wherein each input node is connected to each node in the hidden layer, and each connection between an input node and a hidden node includes a connection parameter associated therewith; and an output layer, the output layer including one or more output nodes, wherein each output node is connected to each node in the hidden layer, and each connection between an output node and a hidden node includes a connection parameter associated therewith.

20. The method of claim 1, further comprising:

training the ANN, wherein training the ANN includes:

providing a training data set to the ANN, wherein the ANN includes a plurality of connection parameters associated therewith;

comparing a predicted output with an expected output; and adjusting the plurality of connection parameters in response to the comparison.

21. The method of claim 20, wherein adjusting the plurality of connection parameters comprises:

performing a quasi-Newton error minimization function.

22. A method for predicting a time duration required for pumping a fluid from a formation through a well to achieve a sample quality, the well having one or more input properties associated therewith, the method comprising:

providing one or more input properties to an artificial neural network (ANN); and receiving from the ANN the time duration for pumping the fluid to achieve the sample quality.

23. A method for predicting a property of a fluid being pumped from a formation through a well, the well having one or more input properties associated therewith, the method comprising:

(a) acquiring a first plurality of data points by measuring a property of the fluid sample at a series of time points;

(b) providing one or more of the input properties to an artificial neural network (ANN);

(c) predicting, using the ANN, a second plurality of data points corresponding to a predicted property of a fluid sample, the second plurality of data points corresponding to the property predicted at series of time points;

(d) substantially time synchronizing the first and second pluralities of data points;

(e) comparing first and second plurality of data points that are synchronized;

(f) modifying one or more of the input properties if the comparison between the second plurality of data points and the first plurality of data points does not meet a condition; and (g) performing (b)–(f) until the comparison meets the condition.

24. The method of claim 23, further comprising:

performing (a) until the comparison meets the condition.

25. The method of claim 23, wherein at least one input property provided to the ANN is an initial estimate of a formation property.

26. The method of claim 23, wherein at least one input property provided to the ANN is a formation property, the formation property is based on data measured by the measuring section.

27. The method of claim 23, wherein modifying one or more of the formation properties is based in part on a Monte Carlo simulation.

28. A system for predicting a property of a fluid suitable for formation testing from a formation through a well, the well having one or more input properties associated therewith, the system comprising:

a formation tester;

a computer operably connected to the formation tester, the computer including a module, wherein the module is configured to:

provide one or more input properties to an artificial neural network (ANN); and receive from the ANN a plurality of data points, each data point corresponding to a predicted time sample of the property of the fluid sample.

29. The system of claim 28, wherein the formation tester is a pumpout wireline formation tester.

30. The system of claim 28, further including one or more packers.

31. The system of claim 30, wherein at least one of the one or more packers is an inflatable packer capable of isolating a section of the well.

32. A system for extracting a fluid suitable for formation testing from a formation through a well, the well having one or more input properties associated therewith, the system comprising:

a formation tester including a chamber configured to collect the fluid;

a computer operably connected to the formation tester, the computer including a module configured to:

provide one or more input properties to an artificial neural network (ANN);

predict a time duration using the ANN for pumping the fluid to achieve a sample quality; and send a signal to the formation tester, the signal including a pumping duration, the pumping duration causes the chamber to collect the fluid sample.

33. The system of claim 32, wherein the formation tester is a pumpout wireline formation tester.

34. The system of claim 32, further including one or more packers.

35. The system of claim 34, wherein at least one of the one or more packers is an inflatable packer capable of isolating a section of the well.

36. A system for extracting a fluid suitable for formation testing from a formation through a well, the well having one or more input properties associated therewith, the system comprising:

a formation tester including:

a chamber configured to collect the fluid;

a measuring section configured to measure one or more properties of the fluid;

a computer operably connected to the formation tester, the computer including a module configured to:

(a) acquire a first plurality of data points from one or more properties of the fluid sample measuring by the measuring section at a series of time points;

(b) provide one or more of the input properties to an artificial neural network (ANN);

(c) predict, using the ANN, a second plurality of data points corresponding to a predicted property of a fluid sample, the second plurality of data points corresponding to the property predicted at series of time points;

(d) substantially time synchronize the first and second pluralities of data points;

(e) compare first and second plurality of data points that are synchronized;

(f) modify one or more of the input properties if the comparison between the second plurality of data points and the first plurality of data points does not meet a condition; and (g) perform (b)–(f) until the comparison meets the condition.

(h) send a signal to the formation tester causing the fluid sample to be collected by the chamber.

37. The system of claim 36, wherein the formation tester is a pumpout wireline formation tester.

38. The system of claim 36, further including one or more packers.

39. The system of claim 38, wherein at least one of the one or more packers is an inflatable packer capable of isolating a section of the well.

40. The system of claim 36, wherein at least one input to the ANN is an initial estimate of a formation property.

41. The system of claim 36, wherein at least one input to the ANN is a formation property, the formation property is based on data measured by the measuring section.

42. The system for claim 36, wherein modifying the one or more formation parameters is based in part on a Monte Carlo simulation.

43. A system for predicting a property of a fluid suitable for formation testing from a formation through a well, the well having one or more input properties associated therewith, the system comprising:

a computer including a module, wherein the module is configured to:

provide one or more input properties to an artificial neural network (ANN); and receive from the ANN a plurality of data points, each data point corresponding to a predicted time sample of the property of the fluid sample.

* * * * *